US006595295B1

(12) United States Patent
Berry et al.

(10) Patent No.: US 6,595,295 B1
(45) Date of Patent: Jul. 22, 2003

(54) ELECTRIC SUBMERSIBLE PUMP ASSEMBLY

(75) Inventors: Michael R. Berry, Norman, OK (US); Yasser Khan Bangash, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 6 days.

(21) Appl. No.: 09/921,746

(22) Filed: Aug. 3, 2001

(51) Int. Cl.[7] ..... E21B 43/00

(52) U.S. Cl. ..... 166/369; 166/378; 166/105; 166/106

(58) Field of Search ..... 166/66.4, 105, 166/106, 369, 378

(56) References Cited

U.S. PATENT DOCUMENTS 4,537,257 A * 8/1985 Todd ..... 166/369
5,201,848 A 4/1993 Powers
5,309,996 A * 5/1994 Sutton ..... 166/286
5,335,732 A 8/1994 McIntyre
6,068,053 A 5/2000 Shaw
6,092,600 A 7/2000 McKinzie et al.
6,123,149 A 9/2000 McKinzie et al.
6,131,655 A 10/2000 Shaw
6,167,965 B1 * 1/2001 Bearden et al. ..... 166/106
6,190,141 B1 * 2/2001 Henry ..... 166/105

* cited by examiner

*Primary Examiner*—David Bagnell
*Assistant Examiner*—Matthew J Smith
(74) *Attorney, Agent, or Firm*—Crowe & Dunlevy, P.C.

(57) ABSTRACT

The present invention provides an electric submersible pumping assembly that includes an encapsulated pumping device containing a pump, an electric submersible motor, a sealing device at the top, and an opening device at the bottom. The lubricant-filled, initially sealed, encapsulated pumping device allows the pump and motor to be run in the wellbore without contamination and be left intact until operated.

17 Claims, 4 Drawing Sheets

ELECTRIC SUBMERSIBLE PUMP ASSEMBLY

FIELD OF INVENTION

The present invention relates generally to the field of electric submersible pump assemblies, and more particularly, but not by way of limitation, to an electric submersible pump assembly having an encapsulated submersible motor and pump.

BACKGROUND OF INVENTION

In oil wells and the like from which the production of fluids is desired, a variety of fluid lifting systems have been used to pump the fluids to the surface. It is common to employ various types of downhole pumping systems to pump the subterranean formation fluids to surface collection equipment for transport to processing locations.

One such prior art pumping system is a submersible pumping assembly which is supported in the wellbore, the submersible pumping assembly having a pump and a motor to drive the pump to pressurize and pass the fluid through production tubing to a surface location. A typical electric submersible pump assembly includes a submersible pump and an electric motor that are directly in contact with the wellbore fluids. Submersible pumping assemblies are often placed in the wellbore months or years before use, causing extended exposure to scale and corrosion. Additionally, motor lubricant can suffer breakdowns such as the loss of motor oil light ends during this period of inactivity. Long periods of inactivity have become more communon, particularly in deep water drill locations where it is expensive to rework a well. The cost of reworking an offshore well to add a submersible pump can be so expensive as to make the remaining reserves uneconomical to produce. Thus, there is a need for a method of effectively protecting the submersible pumping assemblies that are currently being placed in the wellbore and keeping the submersible pumping assemblies free from contamination.

SUMMARY OF THE INVENTION

An electric submersible pumping assembly includes, a first sealing device, a first opening device and an encapsulated pumping device. The encapsulated pumping device is disposed between the first sealing device and the first opening device. The encapsulated pumping device includes a pump assembly, a motor assembly and a device body. The motor assembly includes a seal section operably connected to the pump assembly. The device body forms a chamber around the pump assembly and the motor assembly. The encapsulated pumping device transmits production fluids when the first sealing device and the first opening device are open.

DETAILED DESCRIPTION

Figure 1:
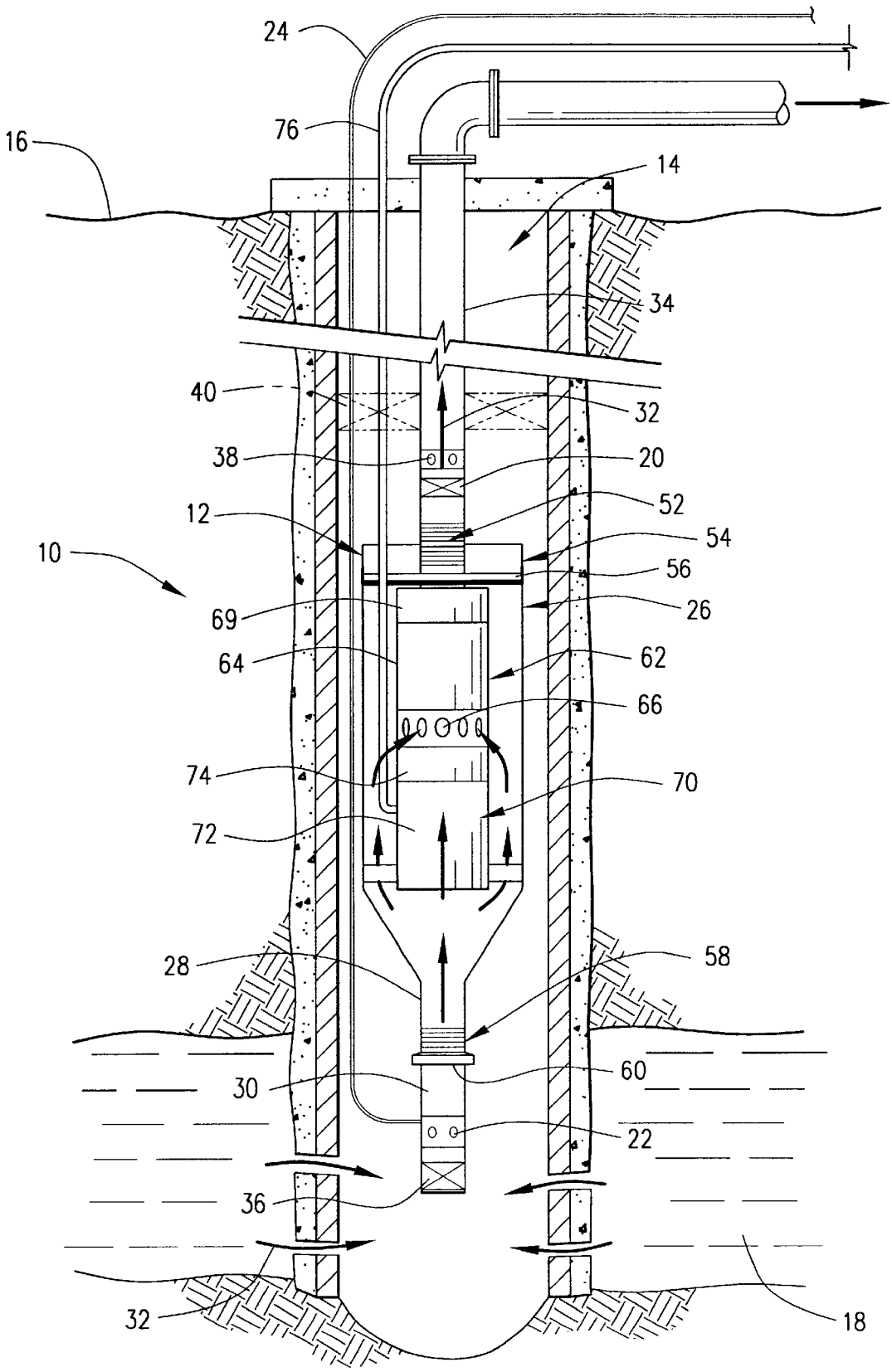
FIG. 1 is a diagrammatical, partially detailed, elevational view of an electric submersible pumping assembly with an encapsulated pumping device constructed in accordance with the present invention.

Referring generally to the drawings, and in particular to FIG. 1, shown therein is an electric submersible pumping assembly 10 constructed in accordance with the present invention. The electric submersible pumping assembly 10 has an encapsulated pumping device 12 for use in a wellbore 14 below ground level or surface 16 and extending through a producing zone 18. Located above the encapsulated pumping device 12 is a first sealing device 20 which can be a pressure sensitive disc, retrievable plug, control valve or other similar device capable of staying closed for a period of time and then being opened. The first sealing device 20 can be mechanically, hydraulically or electrically actuated. Methods of actuating the first sealing device 10 can include use of a pressure sensitive disc or a mechanically actuated plug that is retrieved by wireline or coil tubing.

The electric submersible pumping assembly 10 also has a first opening device 22 below the encapsulated pumping device 12 that will allow produced fluids to enter the encapsulated pumping device 12 when operating the encapsulated pumping device 12. The first opening device 22 can be operated via a control line 24, and can be hydraulically or electrically actuated. Hydraulic power used to actuate the first opening device 22 can be provided by pump discharge pressure.

The encapsulated pumping device 12 has an upper end portion 26 and a lower end portion 28. Attached to the lower end portion 28 is a tail pipe 30 which can be a piece of standard tubing. Produced fluid 32, also known as the production stream 32, can enter the tail pipe 30, be pressurized, and produced to the surface 16 through production tubing 34. The tail pipe 30 can have a second sealing device 36 like the first sealing device 20 described above. The second sealing device 36 can act as a back up to a first opening device 22.

The production tubing 34, above the encapsulated pumping device, can have a second opening device 38 that will allow produced fluids to enter production tubing 34 prior to operating the encapsulated pumping device. The second opening device 38 can include perforations, a sliding sleeve, control valve, or another device that is capable of opening and closing the tubing. The second opening device 38 can be hydraulically, electrically or mechanically actuated such as by wireline or coil tubing. As with the first opening device 22, the second opening device 38 can be manipulated by hydraulic power provided by pump discharge pressure. There can also be an optional packer 40 positioned above the encapsulated pumping device 12.

Figure 2:
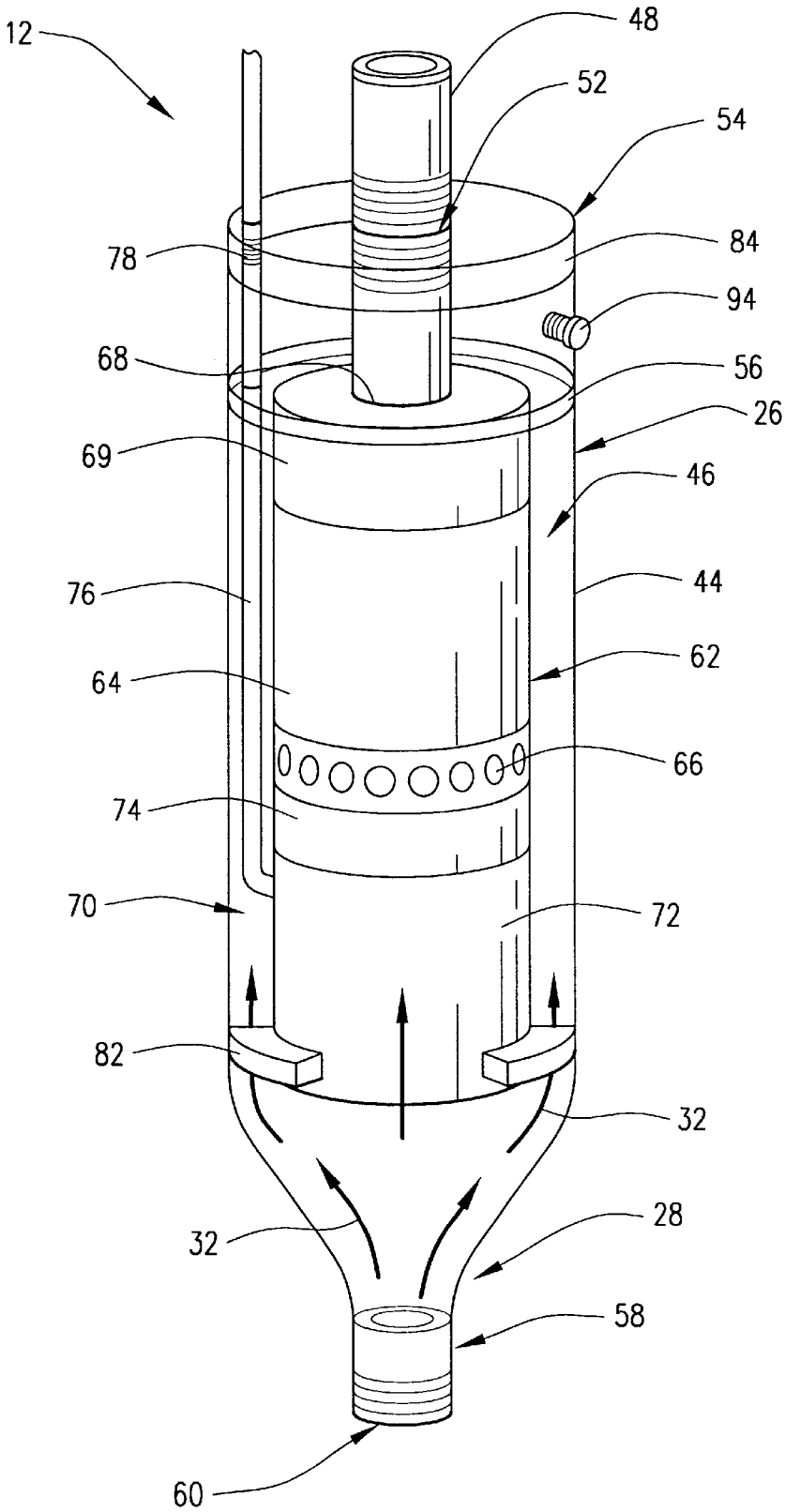
FIG. 2 is a diagrammatical representation in perspective of the encapsulated pumping device of FIG. 1.

FIG. 2 shows the encapsulated pumping device 12 for use in the wellbore 14. The encapsulated device 12 is in fluid communication with the surface 16 and the production zone 18 (shown in FIG. 1). The encapsulated pumping device 12 has a device body 44 forming a chamber 46, the upper end portion 26 and lower end portion 28 being integral portions of the device body 44. The upper end portion 26 is in fluid communication with a pup joint 48 and a device outlet 52. The upper end portion 26 abuts an upper connection device 54 via a pressure seal 56. The upper connection device 54 provides a means of hanging the encapsulated device 12 by the use of the pup joint 48 screwed into the upper connection device 54. The production tubing 34 is attached to the pup joint 48, allowing fluid communication with the surface 16.

The lower end portion 28 abuts a lower connection device 58 and is in fluid communication with a device inlet 60. The lower connection device 58 provides a connection for tail pipe 30. Supported inside the device body 44 is a pump assembly 62 which has a multistage submersible pump 64 with a pump inlet 66 in fluid communication with the production zone 18 via inlet device 60. The pump 64 also has a pump outlet 68, shown here in a pump discharge head 69, which is in fluid communication with the device outlet 52.

The encapsulated electric pumping device also includes an electric submersible motor assembly 70 that drives the multistage submersible pump 64. This motor assembly 70 includes an electric submersible motor 72 supported in the device body 44. A seal section 74 is disposed between the pump assembly 62 and the motor assembly 70. The electric submersible motor 72 is produced by companies such as the assignee of the present invention under model numbers WG-ESP TR-4 and TR-5. The device body 44 also includes a means of power transfer, such as a power cable 76, for transferring power from a power source to the electric submersible motor assembly 70 through a power connector 78 with a pressurized seal. Special provisions can be made in the upper connection device 54 to install a feed-through system for the power cable 76. Such systems provide means of running cable inside encapsulated systems by providing high pressure sealing connections. These systems, such as ESP No. 145395, are readily available from vendors such as Quality Connections, Inc. in Foxboro, Mass.

Figure 3:
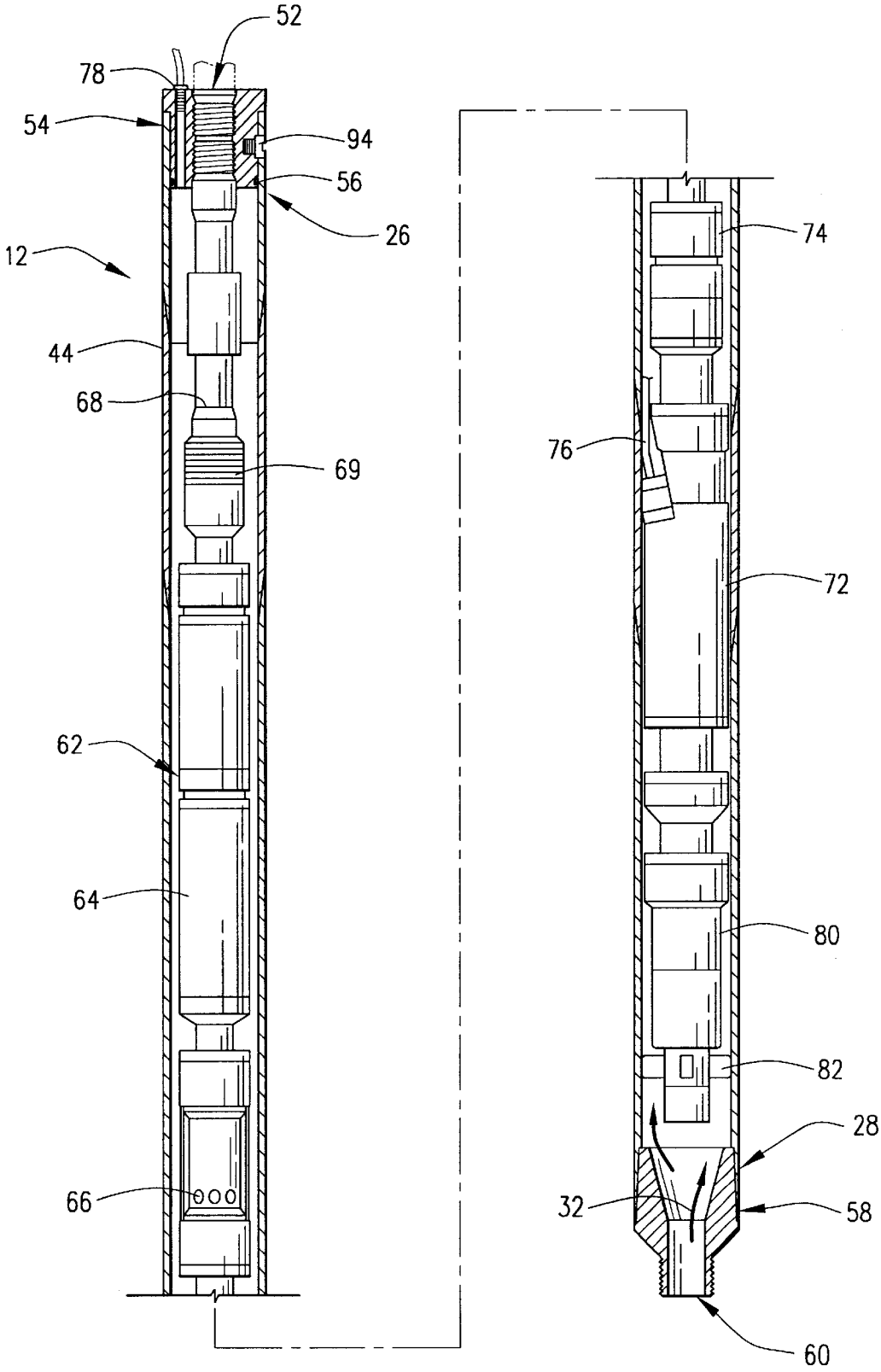
FIG. 3 is a diagrammatical, partially detailed, elevational view of the encapsulated pumping device of FIG. 1.

FIG. 3 shows the encapsulated pumping device 12 of the present invention in more detail. The device body 44 can be made up of a series of casing joints screwed together. The power cable 76 has been removed to make the components of the encapsulated pumping device 12 easier to show.

One skilled in the art will recognize that the encapsulated pumping device 12 can have additional components such as a sensor 80 located adjacent the motor 72 for sensing mechanical and physical properties, such as vibration, temperature, pressure and density, at that location. This sensor, such as the commercially available Promore MT12 or MT13 models available from Promore Engineering, Inc. in Houston, Tex., can also be located adjacent to the pump 64, the motor 72, the surface 16 or other critical locations. One skilled in the art will understand that one or more of these sensors would be helpful to the operation of the encapsulated pumping device 12 in ways such as using the feedback to optimize production by regulating the encapsulated pumping device 12 and its various components. An example would be to use pump pressure feedback to actuate downhole control valves and operate the opening devices and the sealing devices. It is also well known that the use of a centralizer 82, as shown in FIG. 3, can optimize performance of the pumping device.

Figure 4:
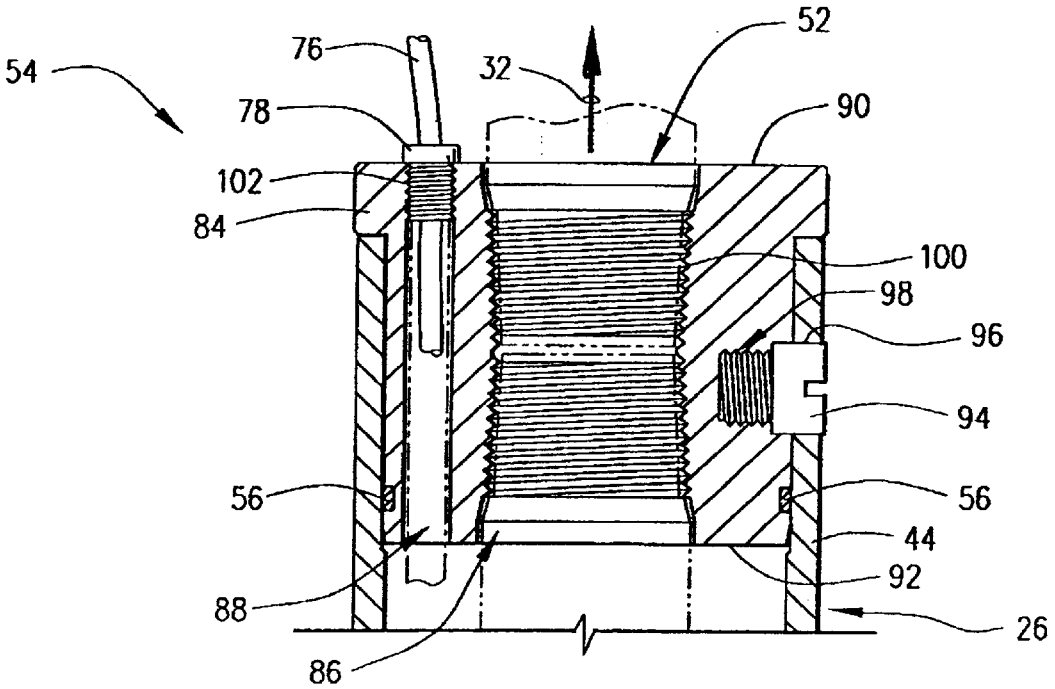
FIG. 4 is a diagrammatical, partially detailed, elevational view of the upper portion of the encapsulated pumping device of FIG. 1.

FIG. 4 shows the upper connection device 54 of the encapsulated pumping device 12. The upper connection device 54 of the present invention is preferably a hanger with a hanger body 84 forming a first chamber 86 and a second chamber 88. The upper connection device 54 has an upper surface 90 and a lower surface 92. The hanger body 84 of the upper connection device 54 is supported by the device body 44 with fasteners 94 that connect an opening 96 in the device body 44 and an opening 98 in the hanger body 84.

The first chamber 86 has a connection, which in the present invention is a threaded connection 100, capable of supporting the pump assembly 62 in the hanger body 84. The second chamber 88 has a connection, which in the present invention is a threaded connection 102, capable of supporting a cable connection in the hanger body 84. The hanger body 84, of the present invention, has the pressure seal 56 disposed between the device body 44 and the hanger body 84. The pressure seal 56 is isolates the pressure within the encapsulated pumping device 12.

Figure 5:
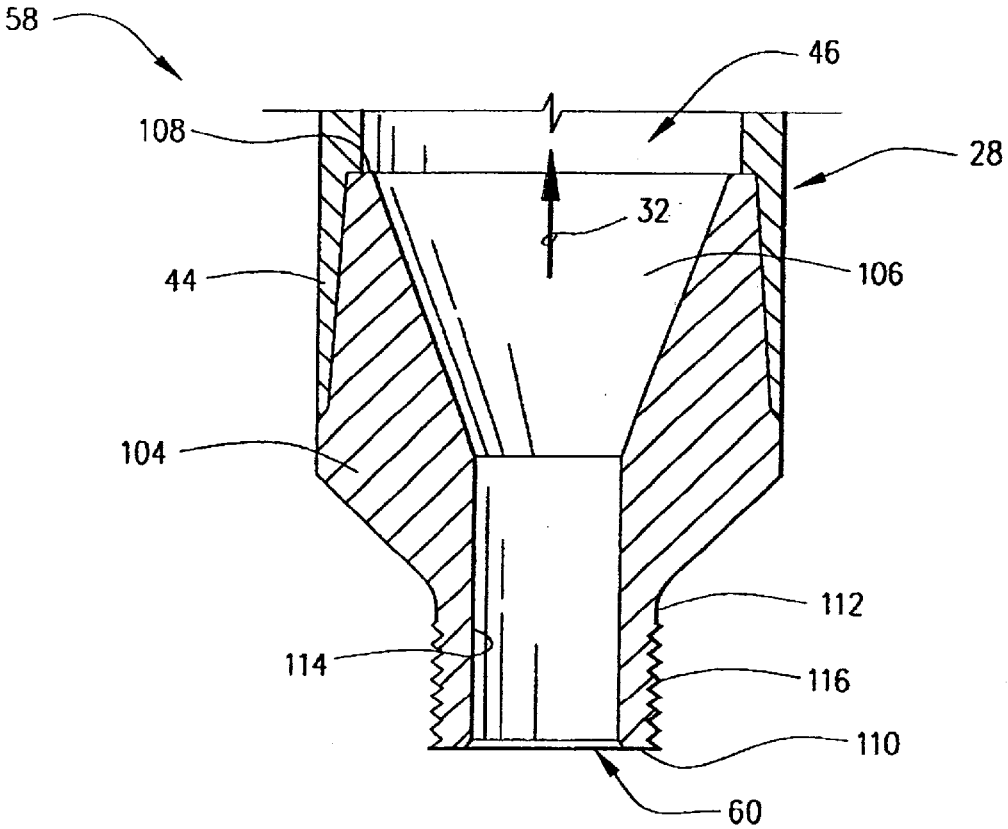
FIG. 5 is a diagrammatical, partially detailed, elevational view of the lower portion of the encapsulated pumping device of FIG. 1.

FIG. 5 shows the lower connection device 58 of the encapsulated pumping device 12. The lower connection device 58 of the present invention has a base body 104 forming a chamber 106 having an upper surface 108 and a lower surface 110. The base body 104 of the lower connection device 58 is supported by the device body 44. The device body 44 can be attached by welding to the base body 104. The device body 44 can also be held by fasteners, such as screws, or a design feature, such as a lip, coupled with external forces. The base body 104 has an outer surface 112 and an inner surface 114 such that the outer surface 112 has a connection means, such as threads 116, capable of supporting other objects, such as joints of tubing or other devices. The lower surface 110 is in fluid communication with the device inlet 60 for accepting the flow of production stream 32.

Tail pipe 30 can be screwed onto the base 104 using the threads 116 of the lower connection device 58 and this tubing can sting into a second packer (not shown). A control valve can be installed with the packer so that when the control valve actuates, the produced fluids 32 communicate with the pump 64.

It will be clear to those skilled in the art that more than one encapsulated pumping device 12 could be used in one wellbore. It will also be clear that additional separators, pumps and/or motors can be used in conjunction with the encapsulated pumping device 12 as well as permanent and semipermanent packers.

The electric submersible pumping assembly 10 with an encapsulated pumping device 12 can be incorporated as one part of a larger pumping device to perform other essential downhole functions. For instance, a gas separator can be attached to the electric submersible pumping assembly 10 with an encapsulated pumping device 12 to handle excess gas before the gas passes through a separator.

The encapsulated pumping device 12 is initially lubricant-filled and sealed, thereby increasing the life expectancy, efficiency, and reliability of the pump and motor portions thereof. The choice of a fluid to be run in the encapsulated pumping device 12 involves a number of considerations related to the storage and operation of the encapsulated pumping device 12. For instance, if a mechanical shock is anticipated prior to start up, a high viscosity fluid would be chosen to minimize the effects of the mechanical shock on the encapsulated pumping device 12.

The production tubing 34, also known as discharge tubing, can be blocked with a sealing device, such as a rupture disc, a retrievable plug or similar device, before the encapsulated pumping device is run in the wellbore 14. The tail pipe 30, also known as intake tubing, can be blocked with a conventional sliding sleeve, as discussed above, before the encapsulated pumping device is run in the wellbore 14.

Prior to operating the encapsulated pumping device, the production stream 32 enters the wellbore 14 from the production zone 18 and flows past the encapsulated pumping device 12. The production stream 32 is produced to the surface 16 through the annulus and enters the production tubing 34 through the second opening device 38, which can be a sliding sleeve, located above the sealing device 20. The optional packer 40 can be added to prevent the fluid from entering the casing annulus for a variety of reasons that would be well known to one skilled in the art. At this time the lubricant filled sealed encapsulated pumping device 12 remains protected from wellbore contaminants.

Before the pump is operated, the second opening device 38 is closed and the first opening device 22 is opened using hydraulic or electrical power. The motor powered pump 64 is started, pressurizing the encapsulated device 12 to a preset level, so that the first sealing device 20 ruptures allowing fluids to be pulled into the encapsulated pumping device 12 through the tail pipe 30 and the first opening device 22. Cooling of the motor 72 can be achieved by maintaining a minimum flow rate velocity of 1 ft/sec of the production stream 32 past the motor 72.

In another embodiment, the encapsulated pumping device 12 is run in the hole with production tubing 34 that has a first sealing device, such as a rupture disc or similar device, and tail pipe that has a second sealing device 36, which can also be a rupture disc. The method of rupturing the first sealing device 20 is to pressure up on tubing 34 from the surface 16 to cause a pressure differential across the disc sufficient to burst the rupture disc. This pressure could also rupture the second sealing device 36 located below the encapsulated pumping device 12. Other surface activated techniques, as are known by those skilled in the art, could also be used to open the first sealing device 20 and the second sealing device 36. These include, for example, the use of wireline or coil tubing activated techniques used to open a mechanically actuated plug. One skilled in the art would be aware of other mechanical, hydraulic or electrical methods of opening the first sealing device 20 and the second sealing device 36.

In operation, when the production stream 32 enters the wellbore 14 the fluid is drawn by the motor powered pump 64 to the pump intake section 66, enters the pump 64, and is pressurized and pumped to the surface 16. If there is significant gas present in the fluid stream, it can be advantageous to use a gas separator-type pump intake or other known methods to handle the gas expansion.

It is clear that the present invention is well adapted to carry out the objectives and to attain the ends and advantages mentioned as well as those inherent therein. While the present invention has been described in varying detail for purposes of the disclosure, it will be understood that numerous changes can be made which will readily suggest themselves to those skilled in the art and which are encompassed within the spirit of the invention disclosed in the above text and in the accompanying drawings.

We claim:

1. An electric submersible pumping assembly for use in a wellbore to pressurize a production stream for production at the surface comprising an encapsulated pumping device comprising:

a device body forming a chamber having an upper end portion and a lower end portion, the upper end portion including a device outlet that abuts an upper connection device and the lower end portion having a device inlet;

a pump assembly disposed within the device body and having a pump inlet in fluid communication with the production stream and a pump outlet in fluid communication with the device outlet; and an electric submersible motor assembly disposed within the device body comprising an electric motor having a seal section operably connected to the pump assembly;

a first sealing device disposed in the wellbore above the encapsulated pumping device; and a first opening device disposed in the wellbore below the encapsulated pumping device.

2. The electric submersible pumping assembly of claim 1 wherein a second opening device is disposed in the wellbore above the encapsulated pumping device.

3. The electric submersible pumping assembly of claim 2 wherein a second sealing device is disposed in the wellbore below the encapsulated pumping device.

4. The electric submersible pumping assembly of claim 3 wherein a packer is disposed in the wellbore above the electric submersible pumping assembly.

5. The electric submersible pumping assembly of claim 1 with the encapsulated pumping device further comprising a sensor device to measure fluid and mechanical conditions and a control device regulating the conditions within the encapsulated pumping device.

6. The electric submersible pumping assembly of claim 1 wherein the upper connection device has a screw type connection in the chamber.

7. An electric submersible pumping assembly for use in a wellbore to pressurize a production stream for production at the surface comprising:

an encapsulated pumping device comprising:

a device body forming a chamber having an upper end portion and a lower end portion, the upper end portion including a device outlet that abuts an upper connection device and the lower end portion having a device inlet, wherein the upper connection device is a hanger connection comprising a hanger body forming first and second chambers and upper and lower surfaces such that the hanger body can be supported by the device body, and a pressure seal to isolate pressure around the hanger body, the second chamber having a means of connecting a cable connection to the hanger body;

a pump assembly disposed within the device body and having a pump inlet in fluid communication with the production stream and a pump outlet in fluid communication with the device outlet, such that the first chamber has a means of connection the pump assembly to the hanger body; and an electric submersible motor assembly disposed within the device body comprising an electric motor with a seal section operably connected to the pump assembly;

a first sealing device disposed in the wellbore above the encapsulated pumping device; and a first opening device disposed in the wellbore below the encapsulated pumping device.

8. A method for protecting an encapsulated pumping device for use in a wellbore to pressurize a production stream for production at the surface, the method comprising:

disposing the encapsulated pumping device in the wellbore, the encapsulated pumping device including a first opening device below the encapsulated pumping device and a first sealing device above the encapsulated pumping device such that the encapsulated pumping device contains a lubricant;

opening the first opening device below the encapsulated pumping device to allow the production stream to pass through a device inlet in the encapsulated pumping device; and powering the encapsulated pumping device to facilitate the movement of the production stream into the encapsulated pumping device.

9. The method of claim 8 further comprising:

pressurizing the lubricant in the encapsulated pumping device to rupture the first sealing device; and allowing the production stream to pass through the encapsulated pumping device to the surface.

10. The method of claim 8, the method further comprising:

pressurizing the first sealing device from the surface through a production string to rupture the first sealing device; and allowing the production stream to pass through the encapsulated pumping device to the surface.

11. A method for protecting an encapsulated pumping device for use in a wellbore to pressurize a production stream for production at the surface, the method comprising:

disposing the encapsulated pumping device in the wellbore, the encapsulated pumping device including a first sealing device above the encapsulated pumping device and a second sealing device below the encapsulated pumping device such that the encapsulated pumping device contains a lubricant;

pressurizing the first sealing device from the surface through a production string to rupture the first sealing device;

pressurizing the second sealing device from the surface through the production string to rupture the second sealing device powering the encapsulated pumping device to facilitate the movement of the production stream into the encapsulated pumping device; and allowing the production stream to pass through the encapsulated pumping device to the surface.

12. An electric submersible pumping assembly, comprising:

a first sealing device;

a first opening device; and an encapsulated pumping device disposed between the first sealing device and the first opening device, the encapsulated pumping device comprising:

a pump assembly;

a motor assembly with a seal section operably connected to the pump assembly; and a device body forming a chamber around the pump assembly and the motor assembly that transmits production fluids when the first sealing device and the first opening device are open.

13. The electric submersible pumping assembly of claim 12, further comprising a second opening device that transmits the production fluids when the first sealing device is closed.

14. The electric submersible pumping assembly of claim 12, further comprising a second sealing device that allows the device body to transmit the production fluids when open.

15. The electric submersible pumping assembly of claim 12, wherein a packer is disposed above the encapsulated pumping device.

16. The electric submersible pumping assembly of claim 12, further comprising a sensor to measure parameters in a wellbore and a control device to regulate the parameters in the wellbore.

17. The electric submersible pumping assembly of claim 12, wherein control valves are actuated by pressure generated by the pump.

* * * * *

UNITED STATES PATENT AND TRADEMARK OFFICE

CERTIFICATE OF CORRECTION

PATENT NO. : 6,595,295 B1
DATED : July 22, 2003
INVENTOR(S) : Michael R. Berry and Yasser Khan Bangash It is certified that error appears in the above-identified patent and that said Letters Patent is hereby corrected as shown below:

Title page,
Item [54], Title, replace "ELECTRICAL SUBMERSIBLE PUMP ASSEMBLY" with -- ELECTRIC SUBMERSIBLE PUMP ASSEMBLY AND METHOD --

Column 1,
Lines 30-31, replace "Long periods of inactivity have become more communon," with -- Long periods of inactivity have become more common, --

Column 4,
Line 6, replace "The pressure seal is isolates the presure" with -- The pressure seal isolates the pressure --

Signed and Sealed this

Thirtieth Day of March, 2004

JON W. DUDAS
*Acting Director of the United States Patent and Trademark Office*